US006367664B1

(12) United States Patent
Bunyan et al.

(10) Patent No.: US 6,367,664 B1
(45) Date of Patent: Apr. 9, 2002

(54) APPLICATOR

(75) Inventors: Glenn Walter Bunyan, Kanwal; Keith Graham Rymer, Somersby, both of (AU)

(73) Assignee: N.J. Phillips Pty, Limited, New South Wales (AU)

( * ) Notice: Subject to any disclaimer, the term of this patent is extended or adjusted under 35 U.S.C. 154(b) by 0 days.

(21) Appl. No.: 09/542,378

(22) Filed: Apr. 4, 2000

Related U.S. Application Data

(63) Continuation of application No. 09/098,273, filed on Jun. 16, 1998.

(30) Foreign Application Priority Data

Jun. 18, 1997 (AU) ..... P07424

(51) Int. Cl.[7] ..... B65D 88/54
(52) U.S. Cl. ..... 222/324; 222/388
(58) Field of Search ..... 222/323, 324, 222/340, 380, 383.1, 388; 417/547, 550

(56) References Cited

U.S. PATENT DOCUMENTS

| | | | | |
|---|---|---|---|---|
| 1,699,347 | A | 1/1929 | Coffin | |
| 1,731,764 | A | 10/1929 | Coffin | |
| 2,435,527 | A | 2/1948 | Arpin | 222/79 |
| 2,595,118 | A | 4/1952 | Anderson | 222/385 |
| 2,915,988 | A | 12/1959 | Sisson | |
| 3,132,775 | A | 5/1964 | Trumbull et al. | 222/453 |
| 3,160,331 | A | 12/1964 | Trumbull et al. | 222/309 |

(List continued on next page.)

FOREIGN PATENT DOCUMENTS

| | | |
|---|---|---|
| AU | 524414 | 7/1980 |
| AU | 567496 | 12/1983 |
| AU | 581740 | 10/1986 |
| AU | 620312 | 1/1988 |
| AU | 675172 | 5/1995 |
| EP | 0772981 | 5/1997 |
| FR | 977061 | 3/1951 |
| FR | 1213107 | 3/1960 |
| GB | 0221032 | 9/1924 |
| GB | 1412312 | 11/1975 |
| GB | 2187962 | 9/1987 |
| NZ | 119560 | 3/1959 |
| NZ | 212087 | 3/1987 |
| NZ | 251119 | 1/1996 |
| NZ | 283376 | 11/1996 |
| WO | 9531697 | 11/1995 |

OTHER PUBLICATIONS

Amended Statement of Case and attached drawings (4 sheets).
Statutory Declaration of Garth Stanley Anderson and attached exhibits.
Statutory Declaration of Malcolm Norman Lynd and attached exhibits.
Statutory Declaration of Paul Fleming Buckley.
Statutory Declaration of Haley Joanne Brown.
Declaration of Malcolm Norman Lynd and attached exhibits.

(List continued on next page.)

*Primary Examiner*—Joseph A. Kaufman
(74) *Attorney, Agent, or Firm*—Ladas & Parry

(57) ABSTRACT

An applicator (33) to deliver viscous liquids such as cream, mayonnaise or mustard. The applicator (33) includes a cylinder assembly (25) which receives a piston (4). The cylinder assembly (25) separates a pair of chambers (26, 27). The piston (4) includes a one-way valve (3) which is resiliently deflectable from apertures (28) in the piston to provide for the flow of liquid from the chamber (26) to the chamber (25). An inlet extends to the chamber (26) while an outlet valve (1) communicates with the chamber (24). This arrangement minimizes hand pressure required by an operator to manipulate the applicator (30) in delivering the viscous liquid.

26 Claims, 5 Drawing Sheets

U.S. PATENT DOCUMENTS

| | | | | |
|---|---|---|---|---|
| 3,231,149 | A | 1/1966 | Yuza | |
| 4,020,838 | A | 5/1977 | Phillips et al. | 128/223 |
| 4,170,253 | A | 10/1979 | McArthur | 222/380 |
| 4,245,757 | A | 1/1981 | Phillips et al. | 222/43 |
| 4,249,868 | A | 2/1981 | Kotyk | 417/511 |
| 4,359,050 | A | 11/1982 | Reynolds | 128/223 |
| 4,530,695 | A | 7/1985 | Phillips et al. | 604/184 |
| 4,642,099 | A | 2/1987 | Phillips et al. | 604/136 |
| 4,673,395 | A | 6/1987 | Phillips | 604/191 |
| 4,676,781 | A | 6/1987 | Phillips et al. | 604/135 |
| 4,717,383 | A | 1/1988 | Phillips et al. | 604/135 |
| 4,758,233 | A | 7/1988 | Phillips et al. | 604/232 |
| 4,784,293 | A | 11/1988 | Hiroshi | 222/79 |
| 4,826,050 | A | 5/1989 | Murphy et al. | 222/175 |
| 5,366,643 | A | 11/1994 | Platter et al. | 210/767 |
| 5,419,458 | A | 5/1995 | Mayer | 222/324 |
| 5,533,879 | A | 7/1996 | Chen | 417/553 |
| 5,634,780 | A | 6/1997 | Chen | 417/553 |

OTHER PUBLICATIONS

Duomatic Brochure RE: "Duomatic 15 mL Drencher/Injector".

Cooper Brochure RE: "Cooper Colt New Model".

Ancare Brochure RE: "Ancare 20 mL Drencher".

Ivomec Brochure RE: "Ivomec Pour–on Gun".

Phillips Brochre RE: Phillips 60 mL non Automatic Drencher.

Phillips Brochure RE: "Phillips 150 mL Single Shot Drencher".

Phillips Brochure RE: "Phillips—Dutjet Jetting Handpiece".

Instrument Supplies Limited MK3 20 mL Drencher Parts List.

Drencher Gun Services 520 20 mL Automatic Drencher Parts and Accessories.

Instrument Supplies Limited 50 mL Drencher Parts List.

PAS 687 2 mL Automatic Vaccination Span Parts.

Henke–Ferro–Matic M86 Parts.

Roux 30 & 50 mL Syringe (Mited Piston Model) Parts.

Supervet Brochure RE: "Supervet Hook Drencher 20 cc".

Syrvet Brochure RE: "Plastic Drench Gun 200 cc".

Graco Brochure RE: "C02026 Pistol Grip Meter Value".

Graco Catalogue RE: C02022 AMU Automatic Metering Value.

Drencher Gun Services Parts Catalogue.

Macnaught Brochure RE: "Macnaught Gear Oil Pump Model C13 & CF13".

Instrument Supplies Limited Designs (8 pages).

APPLICATOR

This application is a continuation of copending application(s) Application Ser. No. 09/098,273 filed on Jun. 16, 1998.

TECHNICAL FIELD

The present invention relates to applicators and more particularly but not exclusively to an applicator to deliver a viscous liquid.

BACKGROUND OF THE INVENTION

The present invention relates to the manual pumping of liquids and more particularly but not exclusively to thick or viscous liquids such as cream, mayonnaise, mustard, sauce etc.

In fast food outlets it is not unusual to have teenagers (particularly young girls) working in food preparation areas. Frequently their tasks will include the application of the above mentioned viscous liquids.

Previously known applicators have suffered from the disadvantage that they are typically designed for adults having considerable hand strength. These previously known devices are therefore most unsuitable to be used in instances where the liquid to be pumped is viscous.

Many manual operated applicators, such as those used in delivering a medication to animals, include a cooperating piston and cylinder, with the piston being spring-urged to a position maximizing the volume within the cylinder. Operation of the applicator compresses the spring which in turn provides a resistance from the view point of the operator. This resistance can be considerable.

OBJECT OF THE INVENTION

It is the object of the present invention to overcome or substantially ameliorate the above disadvantages.

SUMMARY OF THE INVENTION

There is disclosed herein an applicator to deliver a liquid, said applicator comprising:

an interacting piston and cylinder enclosing a first chamber from which the liquid is delivered by the applicator and a second chamber to receive liquid to be delivered to the first chamber;

a liquid outlet extending from said first chamber;

a liquid inlet extending to said second chamber;

a one-way valve connecting said first chamber with said second chamber for the transfer of liquid from said second chamber to said first chamber; and means to cause relative reciprocating movement between the piston and as cylinder to vary the volume of said second chamber and said first chamber to deliver liquid from said first chamber when the volume thereof is decreased while delivering liquid to said second chamber as the volume thereof increases, and delivering to said first chamber from said second chamber liquid as the volume of said second chamber decreases and the volume of said first chamber increases.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
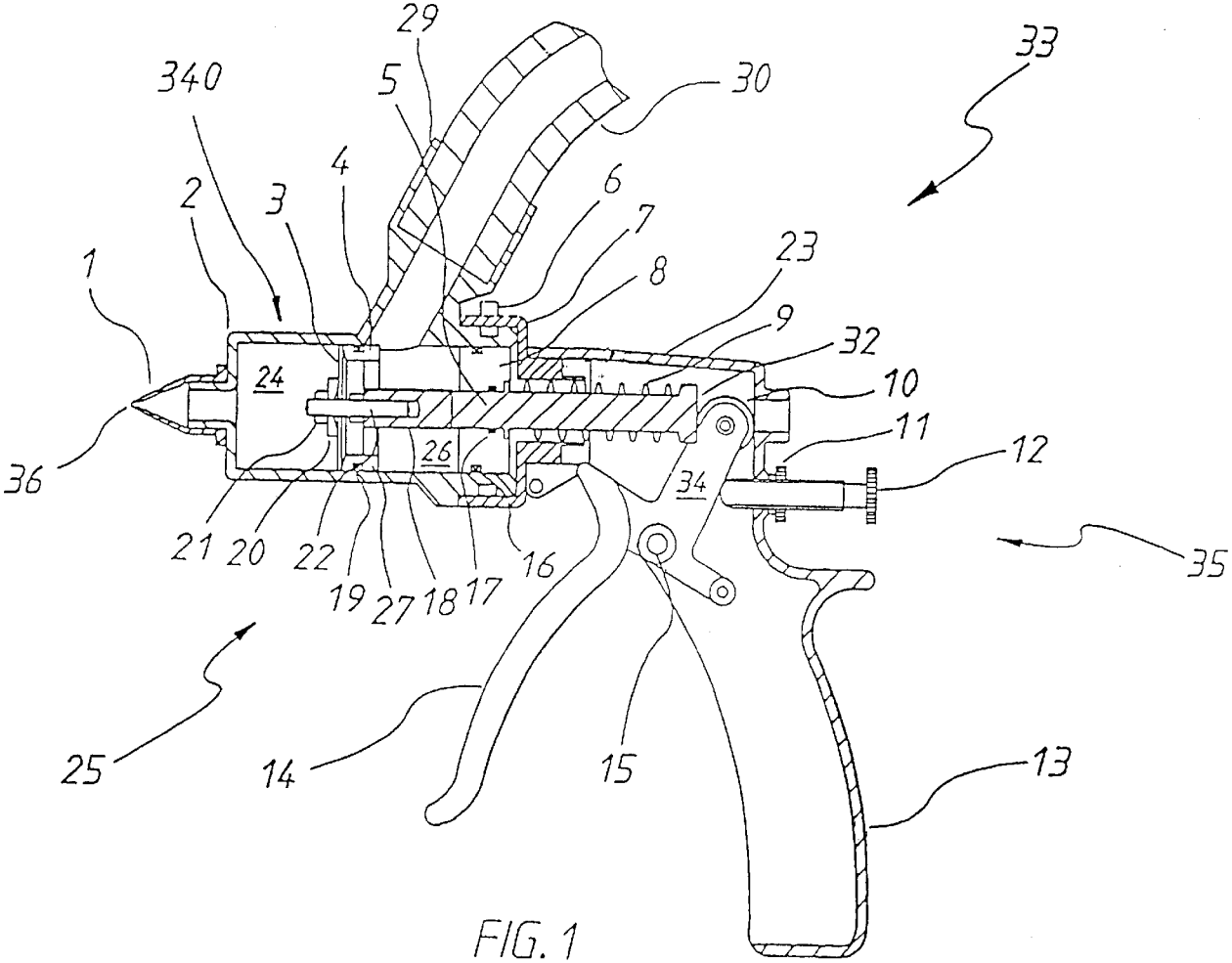
FIG. 1 is a schematic part section side elevation of an applicator to deliver a viscous liquid.
Figure 2:
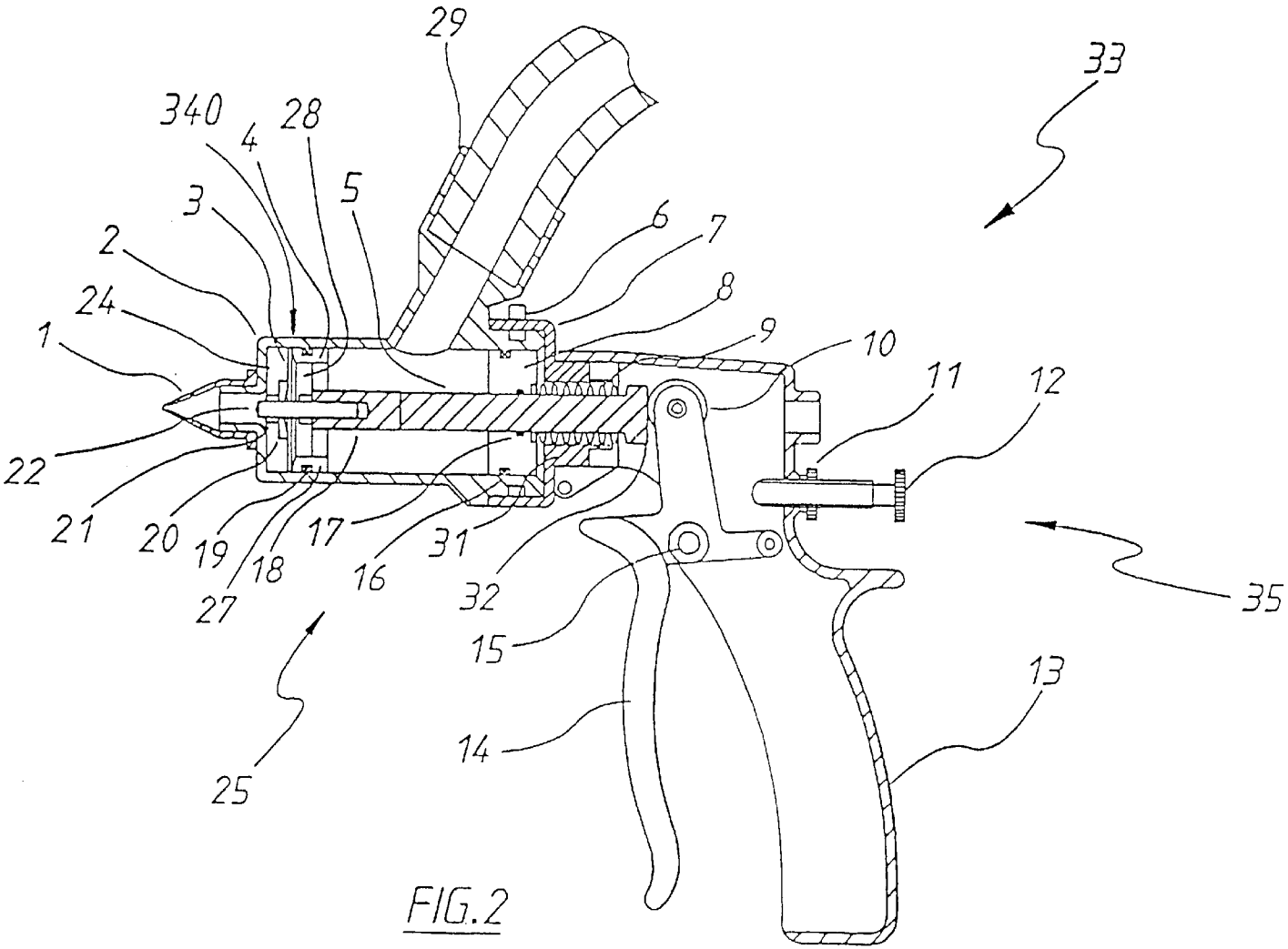
FIG. 2 is a further schematic side elevation of the applicator of FIG. 1.

In FIGS. 1 and 2 of the accompanying drawings there is schematically depicted an applicator 33 to deliver a viscous liquid such as cream, mayonnaise, mustard or sauce.

The applicator 33 includes a body 23 upon which there is mounted an interacting piston and cylinder assembly 25. The assembly 25 includes a cylinder 2 which receives and cooperates with a piston 4 to generally enclose a first chamber 24 and a second chamber 26. The first chamber 24 communicates with a delivery valve 1 via which the liquid is delivered. The valve 1 is a one-way valve inhibiting material being drawn back into the chamber 24 through the valve 1. The chamber 26 is closed at one end by the piston 4 and at the other end by a rear cylinder plug 8. The assembly 25 is attached to the body 23 by means of an adaptor 7. The delivery valve 1 is resilient and expands under pressure to provide an outlet opening (slot) at the tip 36.

The piston 4 includes a piston body 27 which receives and supports a piston seal ring 19. The piston body 27 is provided with one or more apertures 28 via which the liquid can pass from the chamber 26 to the chamber 24. Associated with the aperture 28 is a one-way valve 3 which in essence is a sheet of resilient material which is deflected from the aperture 28 when liquid is flowing from the chamber 26 to the chamber 24. However, the valve 3 prevents reverse flow by being forced back against the valve body 27 and therefore effectively closing the aperture 28. The valve 3 is held in position by means of an inlet valve plate 20 and retaining nut 21. A retaining screw extends from the nut 21 through the plate 20 and valve 3 to be fixed to the piston rod 5. The piston rod 5 extends through the plug 8 and is sealing engaged therewith by means of a push rod seal ring 17. Surrounding portion of the piston rod 5 is a piston rod sleeve 18.

Communicating with the chamber 26 is an inlet 29 to which fluid is delivered via a flexible conduit 30. To reduce resistance to flow, there is no valve in the inlet 29.

The plug 8 is sealingly connected to the cylinder member 340 by means of a seal ring 16.

The adaptor 7 is provided with a socket 31 which receives a return spring 9 which abuts the plug 8 and a flange 32 on the extremity of the piston rod 5. The spring 9 urges the piston rod 5 to move to a position maximizing the volume of the chamber 24. When the chamber 24 is at a maximum volume, the chamber 26 is at a minimum volume. When the chamber 26 is at a maximum volume, the chamber 24 is at a minimum volume.

The adaptor 7 is secured in position by means of a retaining clip 6, by the operation of which the assembly 25 may be removed from the body 23

The body 23 includes a handle 13 which pivotally supports a trigger lever 14 by means of a screw or pivot pin 15.

The trigger 14 is provided with a lever 34 provided with a roller 10. The roller 10 abuts the end flange 32 of the push rod 5 so that upon movement of the trigger 14 towards the handle 13, the roller 10 causes movement of the piston 4 towards the valve 1 thereby decreasing the volume of the chamber 24. Under the influence of the spring 9, upon release of the trigger 14, the trigger 14 is pivoted to its start position and the piston 4 moved to a position at which the chamber 24 is a maximum.

The travel of the piston 4 is determined by a volume adjustment mechanism 35 which includes a threaded shaft 12 readably engaged with the body 23 and having an extremity to abut the trigger 14 to define its rest position. A lock nut 11 secures the shaft 12 in the desired position.

In operation of the above described applicator 33, when the trigger 14 is in its start position (with the chamber 24 having a maximum volume defined by the position of the mechanism 35) and is gripped by a user and moved toward the handle 13, the roller 10 engages the piston rod 5 and moves the piston 4 to reduce the volume of the chamber 24. Liquid is then delivered via the valve 1. At the same time the volume of the chamber 26 is increasing and draws liquid in via the inlet 29. When the trigger 14 is released, action of the spring 9 returns the piston rod 5 to its start position. While the piston rod 25 is returning to its start position, the chamber 24 is increasing in volume and the chamber 26 decreasing in volume. Liquid is transferred between the two chambers via the valve 3.

The above described applicator 33 has the advantage that the hand pressure required to operate the applicator 33 is that pressure required to deliver a predetermined volume contained within the chamber 24 (at its maximum volume). At the same time that the chamber 24 is being reduced in volume to deliver the predetermined volume, the reduction in pressure in the chamber 26 draws a liquid in via the inlet 29. The spring 9 which is responsible for the return stroke need only be strong enough to allow the liquid to pass through the valve 3. By having a relatively large opening provided by the valve 3, resistance to flow is minimized.

The above described applicator 33 has the advantage of reducing the pressure required to operate the applicator 33.

Figure 3:
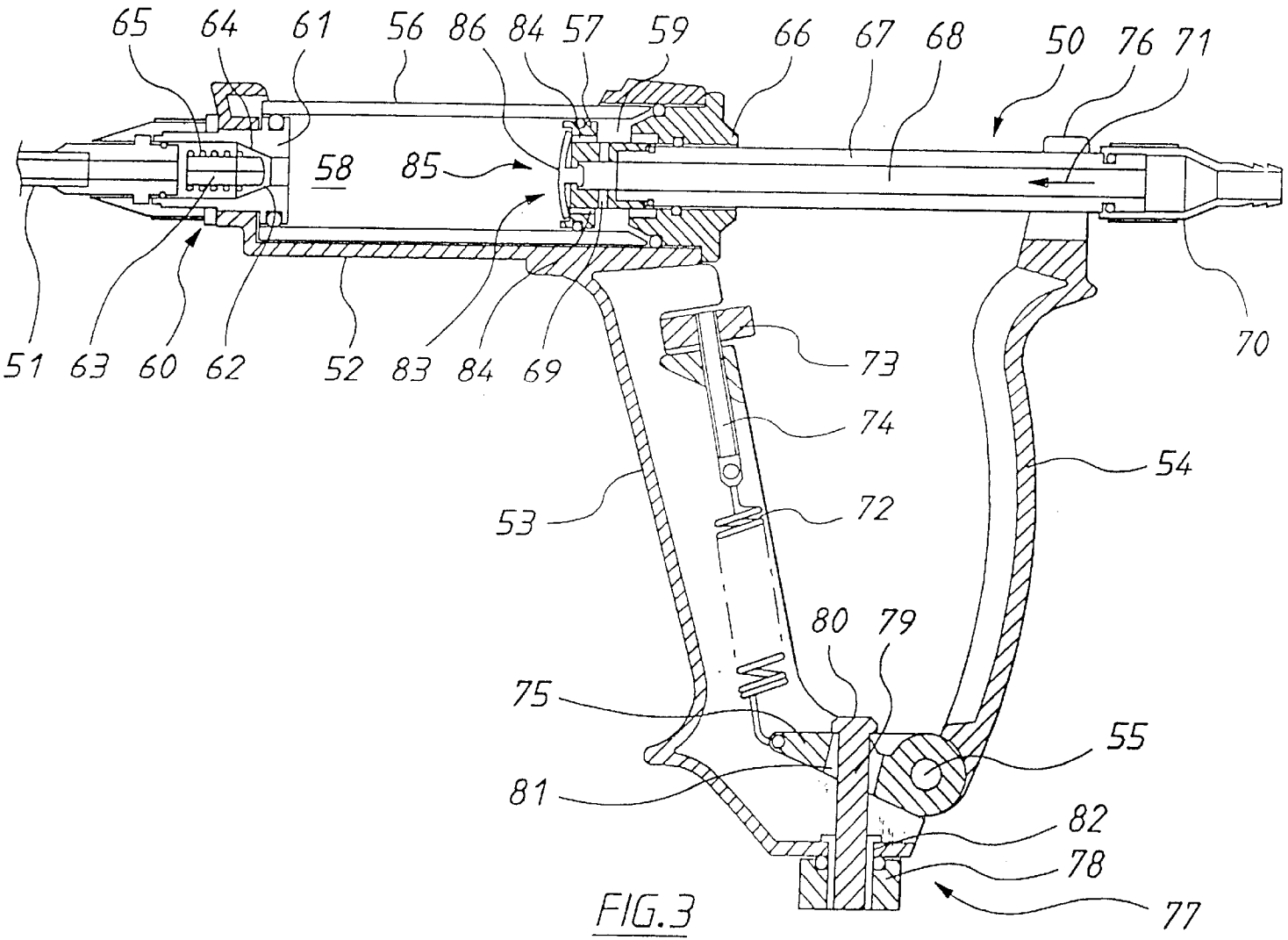
FIG. 3 is a schematic sectioned side elevation of an applicator to deliver a liquid medication to an animal.

In FIG. 3 of the accompanying drawings, there is schematically depicted an applicator 50 to deliver a liquid medication to an animal by means of a nozzle 51. The applicator 50 includes a body 52 incorporating a handle 53 pivotably supporting adjacent its lower end, a trigger 54. The trigger 54 is attached to the handle 53 by means of a pivot shaft 55. Mounted on the body 52 is a cylinder member including cylinder 56 which internally receives a piston 57. The cylinder member with cylinder 56 and piston 57 cooperate to provide a pair of variable volume chambers 58 and 59. The chamber 58 communicates with the nozzle 51 by means of a one-way valve 60, which valve 60 inhibits liquid returning back to the chamber 58 from the nozzle 51. The valve 60 includes a valve body 61 providing a passage 62 which receives a removable valve element 63. The valve element 63 is urged towards the valve seat 64 by means of a spring 65. Pressure within the chamber 58 moves the valve element 63 from a seated position and permits liquid to pass from the chamber 58 to the nozzle 51. When the pressure is reduced, the spring 65 returns the valve element 63 to a seated position, inhibiting reverse flow.

The rear end of the cylinder 56 is closed by means of a plug 66, through which a piston rod 67 passes. The piston rod 67 extends rearwardly from the piston 57. The piston rod 67 is hollow so as to provide a passage 68 which communicates with the chamber 59 by means of radial passages 69 in the piston rod 67. The passage 68 extends rearwardly to a connector 70 which enables a flexible conduit to be connected to the applicator 50 and through which the liquid is delivered to the applicator 50.

Mounted in the handle 53 is a return spring 72 which is adjusted by means of an adjustment nut 73. The nut 73 is threadably engaged with a threaded shaft 74 attached to the spring 72. Rotation of the nut 73 causes longitudinal movement of the shaft 74 and a change in the length of the spring 72. The change in the length of the spring 72 adjusts the tension in the spring 72 and therefore the, return force applied to the piston rod 67 via the trigger 54. The spring 72 is attached to the trigger 54 by an arm 75 of the trigger 54. The upper end of the trigger 54 is provided with a socket 76 which is engaged with the piston rod 67 so that upon movement of the trigger 54 towards the handle 53, the piston rod 67 is caused to move toward the nozzle 51. The spring 72 urges the trigger 54 to move the piston rod 67 in the reverse direction to the arrow 71.

Mounted in the lower end of the handle 53 is a dose adjustment mechanism 77 including an adjustment nut 78. The nut 78 is threadably engaged with a threaded shaft 79 having a head 80 engaged with the arm 75. The shaft 79 passes through a passage 81 in the arms 75. In this respect, it should be appreciated that the nut 78 is captively located in a passage 82 in the lower end of the handle 53. Rotation of the nut 78 causes longitudinal movement of the shaft 79 and therefore the rest position of the trigger 54 relative to the handle 53.

In operation of the above-described applicator 50, an operator places the handle 53 in the palm of a hand and squeezes the trigger 54 toward the handle 53. This moves the piston 57 in the direction of the arrow 71, decreasing the volume of the chamber 58 and increasing the volume of the chamber 59. As the volume of the chamber 58 decreases, liquid is forced through the one-way valve 60 to exit via the nozzle 51. As the chamber 59 increases in volume, liquid is drawn in through passage 68 into the chamber 59. When the trigger 54 is released, the piston 57 is caused to move in the opposite direction to the arrow 71 under the influence of the spring 72. The volume of the chamber 58 increases and the volume of the chamber 59 decreases. Liquid is transferred through the piston by means of a one-way valve 83. The valve 83 includes a plurality of passages 84 extending through the piston 57 to provide for communication between the chambers 58 and 59. Mounted in the piston 57 is a flexible valve member 85. The valve member 85 has a disc portion 86 and a stem 87 secured within the piston 57. The disc portion 86 is formed of resilient material so as to be deflected from the passages 84 to permit the flow of material from the chamber 59 to the chamber 58. This occurs when the piston 57 is moving in the reverse direction to the arrow 71. However, when liquid is being delivered to the nozzle 51, pressure within the chamber 58 pushes the disc portion 86 back against the piston 57 thereby closing the passages 84.

Further to the above, when the piston 57 is moving in the direction of the arrow 71, the volume of the chamber 59 is increasing, drawing liquid in through the passage 68.

Figure 4:
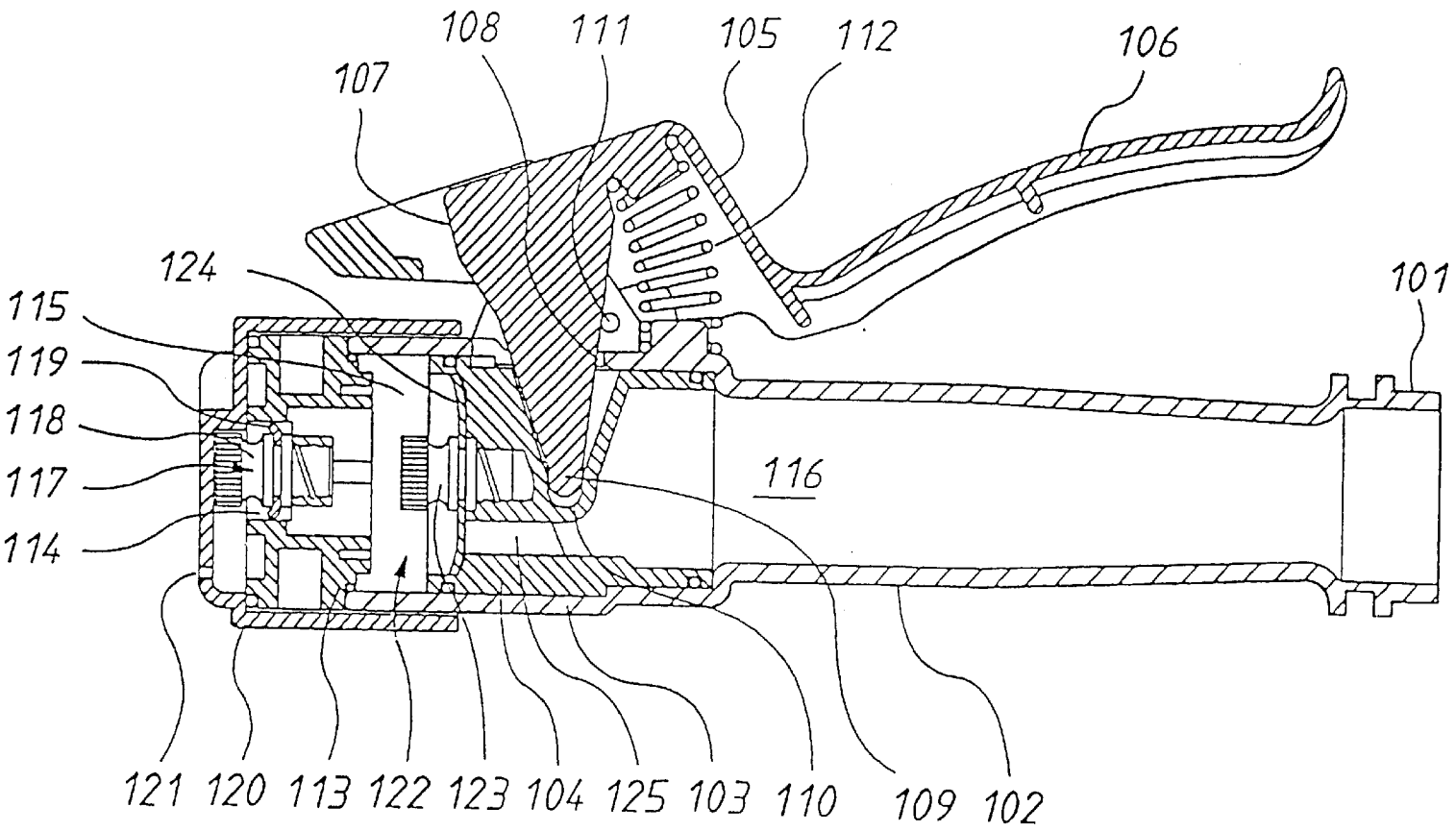
FIG. 4 is a schematic sectioned side elevation of an applicator to deliver a viscous liquid.
Figure 5:
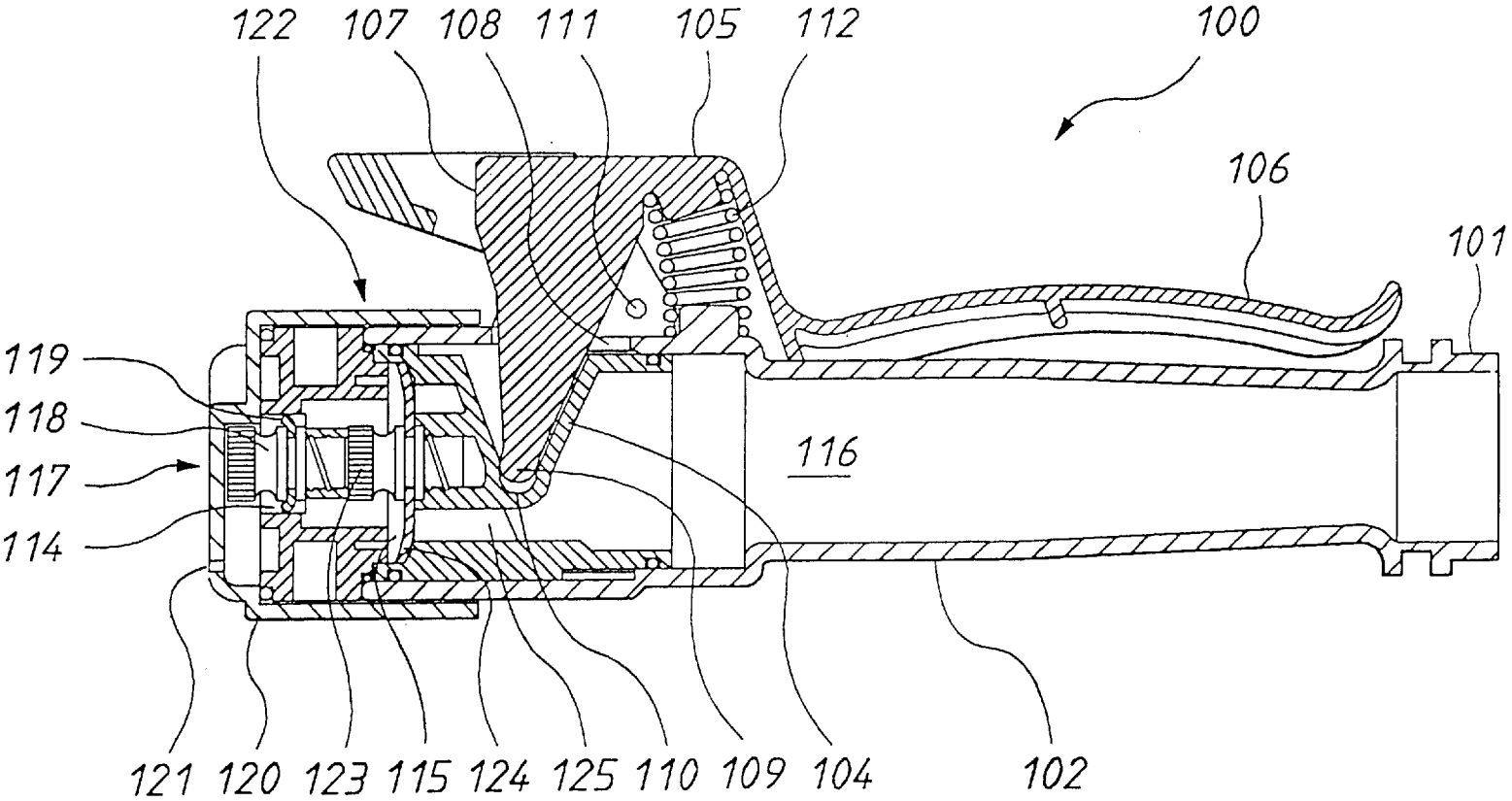
FIG. 5 is a further schematic sectioned side elevation of the applicator of FIG. 4.

In FIGS. 4 and 5 there is schematically depicted an applicator 100. The applicator 100 is intended to deliver a liquid delivered to the applicator 100 via a flexible conduit attached to the end 101.

The applicator 100 includes a body 102 which provides a cylinder member having cylinder 103. The cylinder 103 cooperates with a piston 104 which is caused to reciprocate by a trigger 105. More particularly, the trigger 105 has a lever 106 from which there extends a pivot member 107 through an aperture 108 formed in the body 102. The extremity 109 of the pivot member is actuate and is received within a correspondingly shaped socket 110 formed in the piston 104. The trigger 105 is pivotably mounted on the body 102 by means of a pivot pin 111.

A spring 112 extends between the body 102 and trigger 105 to urge the trigger 105 to the position shown in FIG. 4, that is a position at which the piston 104 is moved rearwardly toward the end 101.

The cylinder 103 receives an end plug 113 providing a passage 114. The plug 113 cooperates with the cylinder 103 and piston 104 to generally enclose a chamber 115. In this respect, the piston 104 separates the chamber 115 from a chamber 116 formed in the handle 102.

Mounted in the plug 113 is a one-way valve 117 including a valve mounting 118 which receives a resilient valve flap 119 urged to close the passage 114.

Surrounding and generally attaching the plug 113 to the body 102 is a protective cap 120. The cap 120 is provided with one or more passages 121 through which are passes to facilitate placement and removal of the cap 120. The valve 117 operates as a one-way valve restricting liquid to flow from the chamber 115 to the passage 121.

Mounted in the piston 104 is a one-way valve 122 which includes a mounting 123 similar in construction to the mounting 118. The mounting 123 is threadably engaged in the piston 104 and secures to the piston 104 a flexible valve flap 124.

Extending through the piston 104 is one or more passages 125 to provide for the flow of liquid from the chamber 116 to the chamber 115.

It should be appreciated that the valve flap 124 is formed of resilient material and selectively closes the passages 125.

In operation of the above-described applicator 100, the cap 120 would be removed and a flexible nozzle attached over the plug 113. When the lever 106 is moved towards the body 102 from the position shown in FIG. 4 to the position shown in FIG. 5, the volume of the chamber 115 decreases, forcing liquid out through the valve 117 and then through the passage or passages 121. At the same time, liquid is drawn into the chamber 116. When the lever 106 is released, the spring 112 returns the lever 106 from the position shown in FIG. 5, to the position shown in FIG. 4. During this movement, the valve flap 124 is deflected from the passage 125 and permits the flow of liquid from the chamber 116 to the chamber 115. At the same time, the valve 117 prevents reverse flow back into the chamber 115. When the lever 106 is being moved toward the body 102, pressure within the chamber 115 deflects the flap 124 back against the piston 104 so as to close the passage 125.

The claims defining the invention are as follows:

1. A hand held and hand operated applicator to deliver a relatively viscous liquid, said applicator comprising:

a body having a handle portion; and delivery means to deliver said relatively viscous liquid, said delivery means including:

an interacting piston and cylinder member mounted on the body and enclosing a first chamber from which said viscous liquid is delivered by the applicator and a second chamber to receive said viscous liquid to be delivered to the first chamber, the cylinder member having a cylinder which receives said piston with said piston separating the first and second chambers;

an operator manipulated trigger operatively associated with the piston and cylinder to cause delivery of said viscous liquid, the trigger being positioned relative to the handle portion so that a user grips the handle portion and trigger in a hand to cause movement of the trigger relative to the handle;

a liquid outlet extending from said first chamber and via which said viscous liquid is delivered;

a liquid inlet extending to said second chamber;

a conduit extending to said inlet through which said viscous liquid is delivered to said inlet, the conduit being provided to connect the applicator to a supply of said viscous liquid;

a one-way valve in said piston connecting said first chamber with said second chamber for the transfer of said viscous liquid from said second chamber to said first chamber while inhibiting flow from said first chamber to said second chamber; and wherein said trigger causes relative reciprocating movement between the piston and cylinder to vary the volume of said second chamber and said first chamber to deliver said viscous liquid from said first chamber when the volume thereof is decreased, while allowing said viscous liquid to enter said second chamber as the volume thereof increases, and delivering to said first chamber from said second chamber said viscous liquid as the volume of said second chamber decreases and the volume of said first chamber increases.

2. The applicator of claim 1, wherein said one-way valve includes at least one passage in said piston to provide for the flow of said viscous liquid from said second chamber to said first chamber, and a resilient valve member operatively associated with said passage to effectively close said passage when said viscous liquid is being delivered from said first chamber, the valve member being resiliently deflected with respect to said passage to permit flow through said passage when said viscous liquid is passing from said second chamber to said first chamber.

3. The applicator of claim 2, wherein said trigger is pivotably mounted on the body and operatively associated with the piston and cylinder to cause said relative reciprocating movement.

4. The applicator of claim 3, wherein said cylinder member is fixed with respect to said body, and said trigger is operatively associated with said piston to cause movement of the piston relative to the cylinder and body.

5. The applicator of claim 4, further including a spring operatively associated with the piston to urge the piston to a position maximizing the volume of said first chamber, and therefore minimizing the volume of said second chamber.

6. The applicator of claim 5, wherein:

said second chamber is closed at an end of said second chamber, opposite said outlet, by a plug mounted in said cylinder member; and a push rod extends from said piston, through said second chamber and plug, to said trigger so that operation of said trigger causes movement of said piston.

7. The applicator of claim 6, wherein said cylinder member is removably attached to said body.

8. The applicator of claim 7, wherein said cylinder member, including said cylinder and piston, are an assembly, removably attached to said body.

9. The applicator of claim 5, further including an outlet one-way valve at said outlet, permitting flow from said first chamber out through said outlet but inhibiting reverse flow.

10. The applicator of claim 9, further including a push rod extending from said piston through said second chamber, and wherein said push rod is provided with a passage allowing said viscous liquid to be delivered via the push rod passage to said second chamber.

11. The applicator of claim 9, wherein said second chamber is closed at an end of said second chamber, opposite said outlet, by a plug mounted in said cylinder member; and a push rod extends from said piston through said second chamber and plug to said trigger so that operation of said trigger causes movement of said piston.

12. The applicator of claim 5, wherein said inlet extends from said cylinder member to communicate with said second chamber.

13. The applicator of claim 12, wherein said second chamber is closed at an end of said second chamber, opposite said outlet, by a plug mounted in said cylinder member; and a push rod extends from said piston through said second chamber and plug to said trigger so that operation of said trigger causes movement of said piston.

14. The applicator of claim 1, further including an outlet one-way valve at said outlet, permitting flow from said first chamber out through said outlet but inhibiting reverse flow.

15. The applicator of claim 1, wherein said inlet extends from said cylinder member to communicate with said second chamber.

16. The applicator of claim 1, further including a push rod extending from said piston through said second chamber, and wherein said push rod is provided with a passage allowing said viscous liquid to be delivered via the push rod passage to said second chamber.

17. The hand held and hand operated applicator of claim 1, wherein said applicator contains said viscous liquid.

18. A hand held and hand operated applicator to deliver a relatively viscous liquid, said applicator comprising:

a body having a handle portion; and delivery means for delivering said relatively viscous liquid, said delivery means including:

an interacting piston and cylinder member mounted on the body and enclosing a first chamber from which said viscous liquid is delivered by the applicator and a second chamber to receive said viscous liquid to be delivered to the first chamber, the cylinder member having a cylinder which receives said piston;

an operator manipulated trigger operatively associated with the piston and cylinder to cause delivery of said viscous liquid, the trigger being positioned relative to the handle portion so that a user grips the handle portion and trigger in a hand to cause movement of the trigger relative to the handle, said trigger including a trigger lever gripped and manipulated by the operator, and a pivot member attached to the lever and entering the body and engaged with the piston so that, upon movement of the lever, said piston is caused to reciprocate relative to said cylinder by pivoting movement of said pivot member;

a liquid outlet extending from said first chamber and via which said viscous liquid is delivered;

a liquid inlet extending to said second chamber;

a conduit extending to said inlet through which said viscous liquid is delivered to said inlet, the conduit being provided to connect the applicator to a supply of said viscous liquid;

a one-way valve in said piston connecting said first chamber with said second chamber for the transfer of said viscous liquid from said second chamber to said first chamber while inhibiting flow from said first chamber to said second chamber;

an outlet one-way valve at said outlet, permitting flow from said first chamber out through said outlet but inhibiting reverse flow; and wherein said trigger causes relative reciprocating movement between the piston and cylinder to vary the volume of said second chamber and said first chamber to deliver said viscous liquid from said first chamber when the volume thereof is decreased, while allowing said viscous liquid to enter said second chamber as the volume thereof increases, and delivering to said first chamber from said second chamber said viscous liquid as the volume of said second chamber decreases and the volume of said first chamber increases.

19. The applicator of claim 18, wherein said one-way valve includes at least one passage in said piston to provide for the flow of said viscous liquid from said second chamber to said first chamber, and a resilient valve member operatively associated with said passage to effectively close said passage when said viscous liquid is being delivered from said first chamber, the valve member being resiliently deflected with respect to said passage to permit flow through said passage when said viscous liquid is passing from said second chamber to said first chamber.

20. The applicator of claim 19, wherein said trigger is pivotably mounted on the body by said pivot member.

21. The applicator of claim 20, further including a spring operatively associated with the piston to urge the piston to a position maximizing the volume of said first chamber, and therefore minimizing the volume of said second chamber.

22. The applicator of claim 18, wherein said inlet extends from said cylinder member to communicate with said second chamber.

23. The applicator of claim 18, wherein the lever extends generally in the same direction as the handle and said pivot member is generally normal to the lever.

24. The applicator of claim 18, wherein said cylinder member is removably attached to said body.

25. The applicator of claim 18, wherein said cylinder member including said cylinder and piston, are an assembly, removably attached to said body.

26. The hand held and hand operated applicator of claim 18, wherein said applicator contains said viscous liquid.

* * * * *